US005373878A

United States Patent [19]

Walker

[11] Patent Number: 5,373,878

[45] Date of Patent: Dec. 20, 1994

[54] LOG CONVEYOR FOR A SCRAGG MILL

[75] Inventor: Jordan D. Walker, Montgomery, Ala.

[73] Assignee: CM Machinery Corporation, Montgomery, Ala.

[21] Appl. No.: 116,030

[22] Filed: Sep. 2, 1993

[51] Int. Cl.[5] ..... B27B 31/00; B27C 1/12; B26D 7/06

[52] U.S. Cl. ..... 144/242 R; 83/409; 83/425.2; 83/423; 144/242 C; 144/245 A; 144/378; 198/735.3

[58] Field of Search ..... 83/409, 423, 425.2, 83/428; 144/3 R, 39, 242 R, 242 A, 242 C, 245 R, 245 A, 245 B, 245 D, 246 R, 246 A, 246 E, 249 R, 249 A, 378; 198/735.1, 735.3, 836.1, 836.3, 841

[56] References Cited

U.S. PATENT DOCUMENTS

| | | | |
|---|---|---|---|
| 3,487,866 | 1/1970 | Mitten | 144/162.12 |
| 4,823,664 | 4/1989 | Cooper, Jr. et al. | 144/378 |
| 4,881,584 | 11/1989 | Wislockery et al. | 83/423 |
| 5,165,518 | 11/1992 | Dietz | 144/245.R |

*Primary Examiner*—W. Donald Bray
*Attorney, Agent, or Firm*—Needle & Rosenberg

[57] ABSTRACT

An aligning log conveyor for a scragg mill comprising a pair of spaced, parallel runners which extend longitudinally in front of the saws. The runners have sharpened top surfaces which form a "V"-shaped trough therebetween to cradle and to stabilize the log. A motorized lug chain disposed between the runners propels the log toward the saw. A shock absorbing stabilizing means with a wheel is positioned above the log for maintaining pressure against the log to remain in contact with the sharpened top surfaces of the runners and in alignment with the saws.

7 Claims, 2 Drawing Sheets

LOG CONVEYOR FOR A SCRAGG MILL

BACKGROUND OF THE INVENTION

This invention relates to a device for aligning and conveying wood, such as in the form of whole logs with the limbs removed, to a scragg mill.

Scragg mills are a common forest product equipment and are used for the primary breakdown of logs into one or more slabs or boards. Typically, the devices will include a conveyor for transporting a log endwise between two or more saws.

Heretofore, existing conveying means have not been a suitable means for maintaining the log's optimum position as it passes forward. Due to the rounded surfaces and irregularities in the log, it exhibits a propensity to shift into an undesirable alignment from the time that it is initially positioned on the conveyor until it reaches the saws. Thus, a reliable means is needed to maintain the log in alignment and to provide a stable support as it is transported through the machining center.

SUMMARY OF THE INVENTION

The disadvantages of the prior art have been overcome by the present invention which comprises a pair of parallel sharpened runners which extend longitudinally from the saw. The log rides atop these sharpened runners which serve to stabilize the log and minimize misalignment.

Furthermore, the sharpened top surfaces of the runners may be supported by a lower body portion that is thicker and more stable. The lower body portions may be configured so as to gradually taper towards the sharpened top surfaces. In one embodiment, the parallel sharpened top surfaces are spaced farther apart, but no more than the diameter of the log, than the lower body portions, forming therebetween a "V"-shape which serves to maintain the alignment of the passing log. The distance between the runners is less than the distance between the saw blades for the stable delivery of wood therebetween. This spacing distance may also be changed by an adjusting means located on the body portions of the runners. The adjusting means also provides a means for adjusting the relative elevation of the runners as well as for the removal of the runners for replacement or resharpening.

The present invention also provides a means for moving the log toward the saw along the runners. In one embodiment, the moving means comprises a pusher lug disposed between the runners which contacts a rear surface of the log to propel the log toward the saws. Furthermore, the pusher lug may be located on an endless lug chain which is disposed about two opposite cog wheels driven by a motor such that the pusher lug travels between the runners in the direction of the saws.

The invention also contemplates an additional stabilizing means positioned above the passing log for minimizing misalignment, which comprises a wheel and a support for rotably moving the wheel above and in engagement with an upper surface of the log, thereby exerting pressure upon the log to remain in contact with the sharpened surfaces of the runners and in alignment with the saw. The preferred embodiments of the stabilizing means further comprises a shock absorbing means to provide a consistent amount of pressure upon the log, and/or a plurality of stabilizing means.

DETAILED DESCRIPTION OF THE INVENTION

Figure 1:
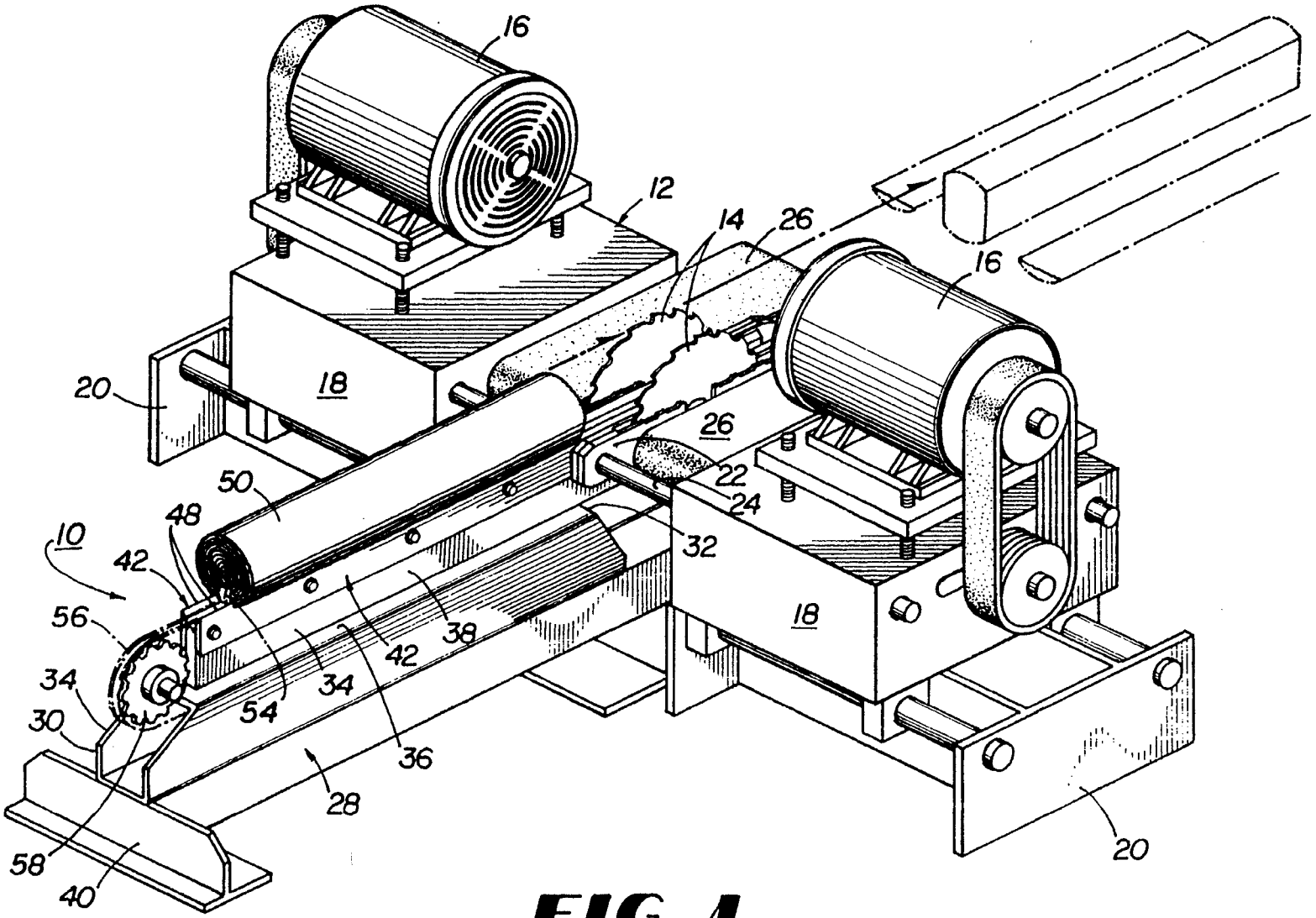
FIG. 1 is a perspective view of the present invention.

The embodiment of this invention 10, is shown in FIG. 1 in connection with a conventional scragg mill 12 that includes a pair of spaced-apart circular saws 14 powered through conventional linkage by electric motors 16 that are mounted on top of saw boxes 18 which are laterally adjustable on saw box frames 20. The upper portion of each of the saws 14 project above blade stabilizers 22 which are secured in place by shafts 24 that laterally extend between the saw boxes 18. Slab conveyor belts 26 are disposed on the outer sides of each saw 14.

The present invention 10 comprises a conveyor frame 28, having opposed ends 30, 32 and opposed, parallel upright side walls 34. A horizontal spanning member 36 connects the tops of the side walls 34 and has an upper surface to which is mounted an upright, rigid member 38. Conveyor feet 40 laterally extend from the bottom 39 of the base 41 which vertically depends from the frame 28 adjacent the ends 30, 32.

Figure 2:
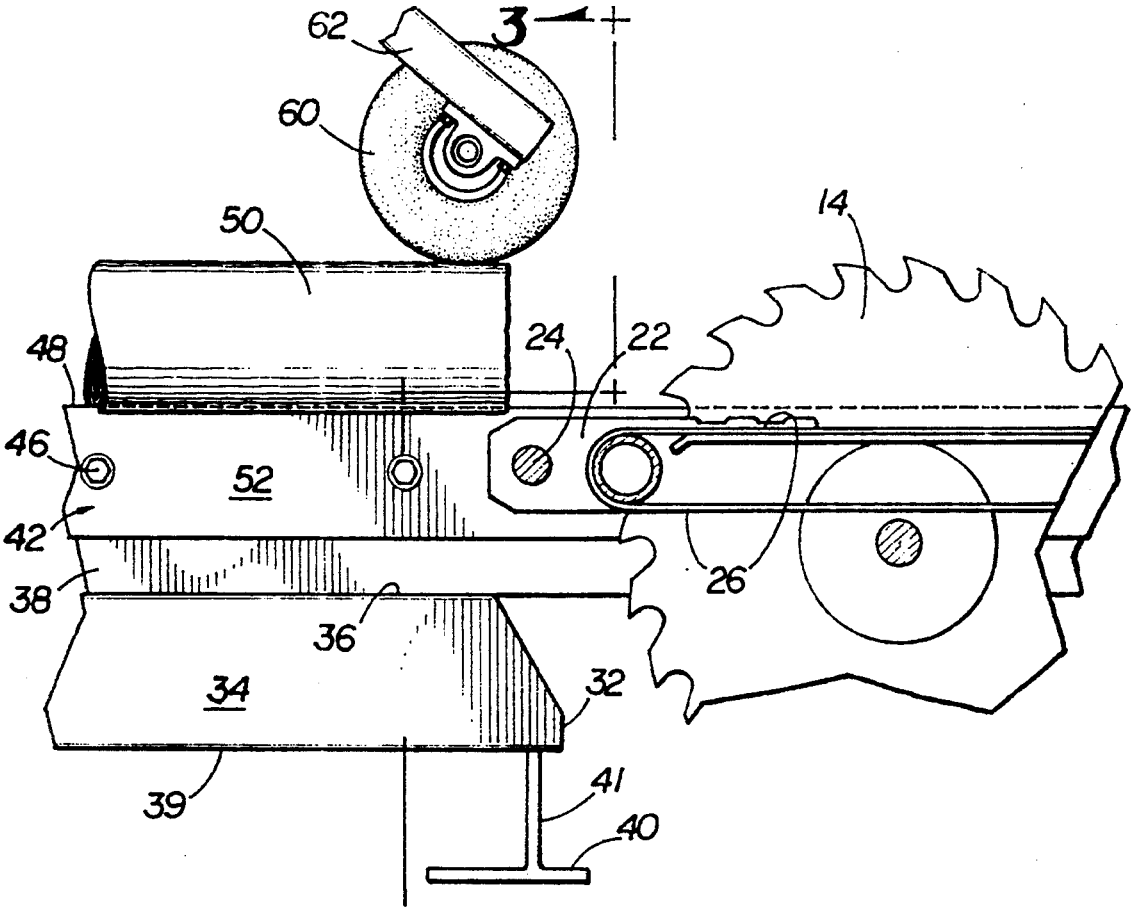
FIG. 2 is a side elevational view of the present invention.
Figure 3:
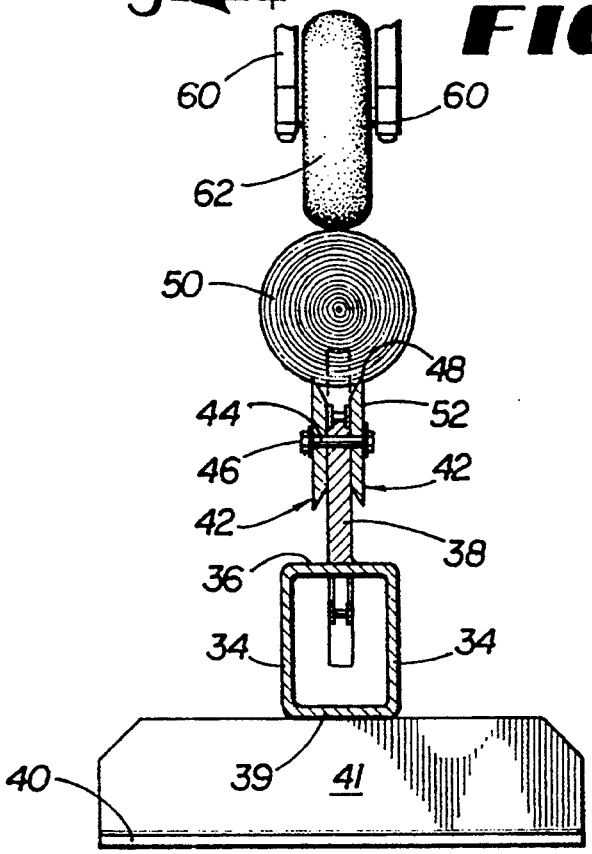
FIG. 3 is a cross-sectional front end view taken along line 3—3 in FIG. 2.

The rigid member 38 provides a means for mounting to the top thereof a pair of longitudinally extending, parallel, spaced apart runners 42. The runners 42 are secured to the member 38 by a plurality of spaced, threaded bolts 44 having nuts 46 on the ends thereof. As seen in FIGS. 2 and 3, the tops of the runners 42 are in the form of a sharpened edge 48 upon which the outer surface of the log 50 rides.

Below the sharpened top edges 48 of the runners 42, are body portions 52, through which the bolts 44 extend. Tapered portions 54 interconnect the sharpened top edges 48 and the body portions 52. As seen FIG. 3, the top edges 48 form a "V"-shape in cross-section which serve to cradle thereon the log 50.

The log 50 is conveyed along the top of the runners 42 by means of pusher lugs 54 mounted on an endless loop lug chain 56 which is disposed about two cog wheels 58 (only one of which is shown) which are mounted at each end 30, 32 and are connected to a conventional motor means (not shown). The motor means drives a pusher lug 54 on the lug chain 56 against a rear surface of the log 50 in the direction of the saws 14. The upper reach of the lug chain 56 travels above the top of the rigid member 38 and between the runners 42.

In the preferred embodiment of FIGS. 2 and 3, a stabilizing means is shown comprising a hold-down, low pressure tire 60 rotably mounted above the log 50 adjacent end 32 and in front of the saws 14 by means of support 62. The wheel 60 thereby exerts pressure upon the log 50 to maintain it in contact with the sharpened top edges 48 of the runners 44 and, thus, in proper alignment with the saws 14. The support 62 is provided with a shock absorbing means (not shown) to provide a consistent amount of pressure upon the log 50 passing therebeneath. Furthermore, more than one wheel 60 may be mounted above the log.

What is claimed is:

1. A device for conveying a log in a desired alignment as it passes to at least one saw, comprising a pair of adjustably fixed runners spaced apart a distance less than the diameter of the log and longitudinally extending in front of the saw, each runner comprising a continuously sharpened top surface, a lower body portion, and a means for mounting the runners beneath the log, wherein the sharpened top surfaces extend parallel to each other along their lengths.

2. The device of claim 1, further comprising a means for moving the log along the runners towards the saw.

3. The device of claim 2 wherein the moving means comprises a pusher lug disposed between the runners which contacts a rear surface of the log to propel the log towards the saw.

4. The device of claim 2, wherein the mounting means comprises a conveyor frame having opposed ends and opposed upright side walls and a horizontal spanning member with an upper surface interconnecting the side walls, the runners being secured onto the spanning member.

5. The device of claim 4, wherein the moving means comprises a pair of cog wheels mounted at the opposed ends of the conveyor frame, an endless lug chain disposed about the cog wheels, a plurality of pusher lugs disposed about the length of the lug chain and a motor means connected to one cog wheel for driving the lug chain such that an upper reach of the lug chain travels above the spanning member and between the runners in the direction of the saw.

6. The device of claim 1, further comprising a stabilizing means positioned above the passing log for minimizing misalignment of the log relative to the saw, wherein the stabilizing means comprises a wheel and a support for rotably mounting the wheel above and in engagement with an upper surface of the log, thereby exerting pressure upon the log to remain in contact with the sharpened top surfaces of the runners and in alignment with the saw.

7. The device of claim 6, wherein the support further comprises a shock absorbing means to provide a consistent amount of pressure upon the log.

* * * * *